US005238995A

United States Patent [19]

Fukunishi et al.

[11] Patent Number: 5,238,995

[45] Date of Patent: Aug. 24, 1993

[54] POLYVINYL ALCOHOL FIBER

[75] Inventors: Yoshiharu Fukunishi, Kurashiki; Akitsugu Akiyama, Soja; Toshiaki Sato, Kiroshiki; Hirofumi Sano, Kurashiki; Akio Ohmory, Kurashiki, all of Japan

[73] Assignee: Kuraray Company Limited, Kurashiki, Japan

[21] Appl. No.: 578,264

[22] Filed: Sep. 6, 1990

[30] Foreign Application Priority Data

Jan. 22, 1990 [JP] Japan ..... 2-13288

[51] Int. Cl.[5] ..... C08F 16/06

[52] U.S. Cl. ..... 525/60; 428/359; 428/364; 526/319

[58] Field of Search ..... 525/60; 526/319; 428/359, 364

[56] References Cited

U.S. PATENT DOCUMENTS

| | | | |
|---|---|---|---|
| 2,909,502 | 10/1959 | Matsumoto et al. | 525/60 X |
| 3,240,738 | 3/1966 | Mitamura et al. | 525/60 X |
| 3,470,125 | 9/1969 | Sliwka | 526/319 X |
| 3,644,308 | 2/1972 | Carpentier | 525/60 |

FOREIGN PATENT DOCUMENTS

| | | | |
|---|---|---|---|
| 0338534 | 10/1989 | European Pat. Off. . | |
| 0020131 | 7/1970 | Japan | 525/60 |
| 0743165 | 1/1956 | United Kingdom | 525/60 |
| 1165486 | 10/1969 | United Kingdom | 525/60 |

OTHER PUBLICATIONS

Database WPIL, accession No. 90-041642[06], Derwent Publications Ltd. London, GB & JP-A1 319 505 (Kuraray K.K.), Dec. 25, 1989.

Journal of Polymer Science, Polymer Chemistry Edition, vol. 26, No. 7, Jul. 1988, pp. 1961-1968, New York, US.

K. Imai, et al: "Poly(Vinyl Alcohol) Obtained Through Polymerization of Some Vinyl Esters".

Patent Abstracts of Japan, vol. 10, No. 292 (C-376) [2348], Oct. 3, 1986 & JP-A-61 108 713(Toray Ind. Inc.), May 27, 1986.

*Primary Examiner*—Joseph L. Schofer
*Assistant Examiner*—J. M. Reddick
*Attorney, Agent, or Firm*—Oblon, Spivak, McClelland, Maier & Neustadt

[57] ABSTRACT

Provided are high-performance polyvinyl alcohol fibers having excellent resistances to hot water and dry heat as well as excellent strength and elastic modulus. The fibers are produced from a highly syndiotactic polyvinyl alcohol containing units from vinyl pivalate in an appropriate amount, which renders it possible to draw the highly crystalline fiber in a high drawing ratio of at least 16.

4 Claims, No Drawings

POLYVINYL ALCOHOL FIBER

BACKGROUND OF THE INVENTION

1. Field of the Invention

The present invention relates to polyvinyl alcohol (hereinafter referred to as PVA) fibers having excellent hot water resistance and high strength and elastic modulus, and to a process for producing the same. The fibers of the present invention are suited for industrial uses including, particularly. reinforcement of composite materials.

2. Description of the Prior Art

PVA fiber has higher strength, elastic modulus, resistances to weather and chemicals, and adhesiveness than polyamide, polyester and polyacrylonitrile fibers and has developed unique uses mostly in industrial field. In recent years the fiber has caught much attention as reinforcement fiber for cement (substitute for asbestos fiber) because of its high alkali resistance.

If a PVA fiber having high resistance to hot water and high resistance to dry heat, as well as still higher strength and elastic modulus, is developed, rubber and plastics reinforced with such fiber and rope, fishing net, tent and the like comprising such fiber would become usable under severer conditions of high temperature or high wet temperature, thereby being superior materials excellent in safety, durability, light weight and like features.

The PVA polymer used for commercially available PVA fibers has a stereochemical structure of an atacitc body having a diad syndiotacticitY of 53 to 54% as determined according to the evaluation method of tacticity of the present invention which will be later described herein. Commercially available PVA fibers obtained from this PVA are insufficient in water resistance and wet heat resistance and cannot be said to have sufficiently high strength and modulus.

For the purpose of obtaining a PVA fiber having improved water resistance, fibers obtained from PVA having high syndiotacticity, or high water resistance in other word, have been persued. Highly syndiotactic PVA's have been obtained from polyvinyl trifluoroacetate and polyvinYl formate, and the obtained PVA's can be dissolved in solvents and be wet spun. See for example Japanese Patent Registration Nos. 539683, 548856, 581737 and 615659. However, although the PVA fibers obtained by these processes have higher water resistance and wet heat resistance than fibers utilizing conventional atactic PVA, the resistances are still insufficient for practical purposes and further the fibers have low strength of 9 to 11 g/d.

The use of highly syndiotactic PVA for the purpose of improving, besides water resistance, strength and elastic modulus of the fibers obtained therefrom has been proposed. Thus, Japanese Patent Application Laid-open No. 108713/1986 discloses a pProcess which comprises obtaining a PVA from vinyl trifluoroacetate, which has a diad syndiotacticity as defined in this specification of 58%, dissolving the PVA in dimethyl sulfoxide (hereinafter referred to as DMSO) or glycerine and conducting dry-jet-wet spinning to obtain fiber having a single filament strength of 15 g/d at most and elastic modulus of about 380 g/d at most. However, these values are of not so high level and the wet heat resistance is, like in the above Japanese Patents, not sufficient.

Japanese Patent Application Laid-open Nos. 130314/1984, 289112/1986 and 85013/1987 disclose processes which comprise using high-polymerization degree PVA to obtain fibers having a strength of 19 to 29 g/d, an elastic modulus of 550 to 650 g/d. These fibers are, however, cannot be said to have sufficient hot water resistance.

Crosslinking treatment is known for the purpose of improving the hot water resistance of PVA fiber. See for example Japanese Patent Application Laid-open Nos. 120107/1988, 156517/1989 and 207435/1989. However the crosslinking causes the resulting fiber to decrease its drawability, whereby the obtained finished fiber becomes insufficient in strength and modulus.

SUMMARY OF THE INVENTION

In view of the foregoing, an object of the present invention is to provide a PVA fiber having excellent hot water resistance, as well as excellent strength and elastic modulus.

The present inventors have studied, for the purpose of obtaining the desired fiber, on the fiber structure while taking the following Points into consideration.

(1) more complete crystal=solid intermolecular hydrogen bonding . . . (employment of highly syndiotactic PVA)

(2) high orientation of crystalline region and amorphous region . . . (high drawability of as-spun fiber)

(3) solid tie molecules between crystalline region and amorphous region . . . (employment of highly syndiotactic and high-polymerization-degree PVA)

(4) suppression of affinity to water . . . (introduction of hydrophobic group)

Thus, the present inventors have intensively studied on how to prepare highly syndiotactic PVA and how to draw the highly crystalline fiber obtained from the PVA in a higher drawing ratio.

As a result, it was found that a PVA obtained from vinyl pivalate monomer has markedly high syndiotacticity. Further study on fibers obtained from said PVA derived from vinyl pivalate revealed that incorporation of hydrophobic units from vinyl pivalate, which produce steric hindrance to an appropriate extent into PVA in an appropriate amount can improve the low drawability of highly syndiotactic PVA without appreciably deteriorating the high crystallinity of the highly syndiotactic PVA. It was also found that the above effect is produced when vinyl Pivalate units are contained in an amount of 0.05 to 10 mol %. Still further it was found that, in Producing fiber, it is Preferred to conduct, for the purpose of dry heat drawing the fiber to a high ratio, drawing in 2 or more stages at specified temperatures selected depending on the melting point of the polymer.

As stated above, the present invention has rendered it possible to obtain a high-performance fiber utilizing highly crystalline PVA and still having high drawability, which leads to achievement of high hot water resistance at the same time with high strength and modulus.

Thus, the present invention Provides a PVA fiber formed from a PVA having a viscosity average Polymerization degree of at least 1,500 and a syndiotacticity of at least 58% and containing vinyl pivalate component, said PVA fiber having a breaking temperature in hot water of at least 132° C. and a single-filament strength of at least 17 g/d.

The present invention further provides a PVA fiber, of which the breaking temperature in hot water and the single-filament strength satisfy the following relationships:

$$WTb \geqq 1.2(\bar{P})^{0.35} + 117 \quad [1]$$

$$DT \geqq 12(\bar{P})^{0.1} - 7.5 \quad [2]$$

where:

WTb = breaking temperature in hot water (° C.) under 2 mg/d load

DT = single-filament strength (g/d)

P = viscosity average polymerization degree of PVA.

The present invention still further provides a process for producing a PVA fiber which comprises:

dissolving a PVA having a viscosity average polymerization degree of at least 1,500 and a syndiotacticity of at least 58% and containing vinyl pivalate component in a solvent, spinning the obtained solution into a fiber as spun in the usual manner, and dry heat drawing the obtained fiber as spun in such a manner that the total drawing ratio will be at least 16.

DETAILED DESCRIPTION OF THE PREFERRED EMBODIMENTS

The polymerization degree of PVA polymer as referred to in the present invention means the viscosity average polymerization degree determined from the intrinsic viscosity (measured at 30° C.) of a solution in acetone of the polyvinyl acetate obtained by acetylation of the specimen polymer as $$\bar{P} = ([\eta] \times 1000/7.94)^{1/0.62}.$$

It is necessary that the PVA polymer used in the present invention have the above polymerization of at least 1,500. If the polymerization degree is less than 1,500, it will become very difficult to obtain the desired fiber of the present invention having the high hot water resistance and high strength and modulus. The polymerization degree is preferably at least 6,000 and more preferably at least 10,000.

It has been found that, in the present invention, where there is used a PVA polymer having a polymerization degree within the above-specified range and a diad syndiotacticity of at least 58% and containing units from vinyl pivalate in an appropriate amount, the PVA can, substantially, yield a high-performance fiber having a breaking temperature in hot water of at least 132° C. or even at least 135° C. and a single-filament strength of at least 17 g/d even when the polymerization degree is in a considerably lower range (for example about 2,000). Furthermore, PVA's having a polymerization degree of at least 6,000 or, further, at least 10,000 can yield super-high-performance fiber having still better hot water resistance and mechanical properties.

While, as stated above, the properties of the fiber obtained according to the present invention become better with the increasing polymerization degree of the PVA used, the more desirable fibers obtainable by the present invention are those high-performance fibers of which the polymerization degree, the hreaking temperature in hot water and the single-filament strength satisfy the afore-mentioned relationships [1] and [2].

If the syndiotacticity of a PVA is less than 58%, the PVA will not crystallize sufficiently, thereby hardly yielding the high-performance fiber as defined in the present invention. The syndiotacticity is preferably at least 60%; but a syndiotacticity exceeding 70% leads to too high a crystallization, whereby it becomes difficult to dissolve the PVA in a solvent and the obtained as-spun fiber tends to become of low drawability. In the present invention, incorporation of a small amount of units from vinyl pivalate into such PVA can increase the drawability of the obtained fiber by action of steric hindrance. Then the highly drawn fiber will be of high strength and elastic modulus, and further of significantly improved hot water resistance thanks to high orientation and crystallization of the PVA molecules and, in particular, to introduction of the hydrophobic groups into the PVA molecules. Accordingly, the present invention is based on the finding that vinyl pivalate unit has such an appropriate bulkiness as to disturb the stereoregularity of PVA, thereby increasing the drawability of the fiber spun therefrom, without impairing the crystallinity to a large extent.

It is preferred that vinyl pivalate component is contained in PVA in an amount of not more than 10 mol %. If the content exceeds 10 mol %, the vinyl pivalate units contained will hinder the crystallization of the PVA, whereby the strength, elastic modulus and melting point of the obtained fiber decrease. On the other hand, if the vinyl pivalate content is too small, i.e. less than 0.05 mol %, the effect of its presence will not be produced. The content of vinyl pivalate units is more preferably in a range of from 0.3 to 5 mol %.

The above-described highly syndiotactic PVA containing vinyl pivalate component can be produced by for example polymerizing vinyl pivalate as starting monomer and then saponifying the obtained polymer in a saponification degree of 90 to 99.95 mol %, or by any other processes.

Several processes have been proposed for producing highly syndiotactic PVA, including one which comprises saponifying polyvinyl pivalate. For example, Sakaguchi et al reported that a PVA is prepared by saponifying polyvinyl pivalate in a acetone/water mixed solvent in the presence of potassium hydroxide (cf. KOBUNSHI KAGAKU, 27, 758–762, (1970)). However, polyvinyl esters. having bulky side chains, such as polyvinyl pivalate, are generally difficult to hydrolyze due to their steric hindrance, and such polyvinyl esters do not give sufficiently saponified PVA's by alkali saponification under conditions generally employed for the saponification of polyvinyl acetate. Thus, the PVA obtained in the above report by Sakaguchi et al had a saponification degree of only about 52%, and PVA's of this low saponification degree are difficult to form into fibers. It has been found that saponification of homopolymer or copolymers of vinyl pivalate in the substantial absence of oxygen or in the presence of an oxidizing agent can provide a PVA having a saponification degree of at least 90 mol %. By this process it has become possible to control the content of unsaponified vinyl pivalate down to a small percentage of 10 mol % or below.

Highly syndiotactic PVA's can be obtained by, besides the above process which utilizes vinyl pivalate monomer as starting monomer, saponification of polyvinyl esters with bulky side chains such as polyvinyl trichloroacetate, polyvinyl trifluoroacetate and polyvinyl formate, by saponification of highly polar polyvinyl esters and by decomposition of polyvinyl ethers such as t-butyl vinyl ether and trimethylsilyl vinyl ether. The thus obtained PVA's can then be copolymerized with a small amount of vinyl pivalate to give the PVA's used in the present invention.

The diad tacticity referred to in the present invention is the triad syndiotacticity determined by proton-NMR spectrometry of a specimen PVA dissolved in deuterated dimethyl sulfoxide ($d_6$-DMSO) {cf. T. Moritani et al, Macromolecules, 5, 577 (1972)}, which is calculated from syndiotacticity (S), heterotacticity (H) and isotactivity (I) as $s=S+H/2$ (diad syndiotacticity)

$i=I+H/2$ (diad isotacticity)

The PVA used in the present invention may optionally contain not more than 3% by weight of pigments, antioxidants, ultraviolet absorbers, crystallization inhibitors, crosslinking agents, surfactants and like additives.

Examples of the solvent used for dissolving the PVA are polyhydric alcohols such as glycerine, ethylene glycol, diethylene glycol, triethylene glycol and 3-methylpentane-1,3,5-triol, dimethyl sulfoxide (DMSO), dimethylformamide, dimethyl acetamide, N-methylpyrrolidone, 1,3-dimethyl-2-imidazolidinone, ethylenediamine, diethylenetriamine and water. These may be used singly or in combination. Also usable are aqueous solutions of inorganic salts that can dissolve the PVA, such as zinc chloride, magnesium chloride, calcium thiocyanate and lithium bromide. Polyhydric alcohols that gel by cooling, dimethyl sulfoxide, dimethylformamide and mixed solvents of the foregoing with water are preferred in view of spinning stability.

The PVA solution can be spun by any conventional process, such as wet spinning, dry spinning or dry-jet-wet spinning. It is however preferred to use a process of dry-jet-wet spinning which comprises extruding the PVA solution into an atmosphere of air or an inert gas and immediately thereafter immersing the extruded solution in a low-temperature alcohol such as methanol or ethanol a mixed solution thereof with the solvent used, or an aqueous solution containing an inorganic salt or a base, thereby rapidly cooling the solution to obtain a uniform and transparent gel fiber.

Coagulation at a low temperature of 20° C. or below to suppress crystallization, since the highly syndiotactic PVA used in the present invention more readily crystallizes than atactic PVA, and to slow down the rate of solvent extraction will yield a uniform gel fiber, which can then be drawn in a high drawing ratio to be formed into a high-performance fiber.

It is recommended that the fiber as spun be, while still containing the solvent, wet drawn in a ratio of at least 2, preferably at least 4 for the purpose of increasing the drawability by preventing the cross-sectional deformation and sticking of the gel fiber and by destroying the microcrystals formed at the spinning. The fiber is then removed of almost all the solvent with an extracting agent, e.g. alcohols such as methanol and ethanol, acetone and water, dried to evaporate off the extracting agent and heat drawn to a total drawing ratio of at least 16.

Conventional syndiotactic PVA's have been able to be drawn to a total drawing ratio of about 16 at most because of their high crystallinity. The PVA used in the present invention can, in spite of its higher syndiotacticity and crystallinity than conventional syndiotactic PVA's, be drawn to as high a total draft as at least 16, whereby high strength and highly improved hot water resistance are achieved. Further study on the dry heat drawing process for the fibers of the highly syndiotactic PVA revealed that drawing in 2 or more stages with a temperature gradient is effective for achieving high-ratio drawing to enhance the orientation and crystallization of molecules, while suppressing the decrease in the Polymerization degree. The 1st stage drawing is preferably conducted at a temperature of from (MP−90° C.) to (MP−50° C.), wherein MP represents the melting point of the PVA. With a temperature of lower than (MP−90° C.), the drawability will decrease and the predrawing effect will be decrease, resulting in low performances of the obtained fiber. On the other hand, a 1st stage temperature exceeding (MP−50° C.) will cause a rapid crystallization to occur, thereby rendering it difficult to further draw in high ratios at the 2nd stage drawing and thereafter. The 2nd stage drawing and the succeeding drawings are preferably conducted at a temperature of from (MP−40° C.) to (Mp+15° C.). With a temperature of lower than (Mp−40° C.), it is difficult to draw to a high drawing ratio, while a temperature exceeding (MP+15° C.) will cause the strength and elastic modulus of the obtained fiber to decrease due to decomposition of PVA and flow of molecular chains. The temperature herein means that of the heating medium or device through or on which the fiber runs. The enhanced molecular orientation and high strength of the fiber being drawn well stand a high temperature of (MP+15° C.) and the fiber will not break by fusion. The drawings at the 2nd stage and thereafter is preferably conducted in a shorter time as higher temperature is selected, since a total residence time at the 2nd stage drawing and thereafter of at least 60 seconds will tend to cause the fiber to discolor. On the other hand, with the total residence time of less than 5 seconds, it is difficult to sufficiently orient and crystallize the molecular chains and, particularly, to obtain the fiber of the Present invention having a breaking temperature in hot water and single-filament strength that satisfy the relationships [1] and [2] described hereinbefore. The residence time is more preferably in a range of from 10 to 50 seconds.

The total draft or drawing ratio, which is expressed by the product of wet drawing ratio and dry heat drawing ratio, is at least 16, preferably at least 18. If the total draft is less than 16, the molecular orientation of the obtained fiber will be insufficient and its strength, elastic modulus and hot water resistance will decrease.

The fiber can be dry heat drawn by any process, e.g. by hot air non-contact process, by hot-plate contact process, by zone drawing, in liquid bath of solvent or nonsolvent and in hot inert gas atmosphere. A process which comprises utilizing only one drawing oven in which a temperature gradient is settled such that the fiber is drawn at 2 or more stages is also included in the present invention.

The thus drawn fiber of a highly syndiotactic PVA containing vinyl pivalate component has a breaking temperature in hot water (WTb) of at least 132° C. and a single filament strength (DT) and elastic modulus of at least 17 g/d and at least 400 g/d, respectively. Although WTb and DT of a PVA fiber are generally proportional to the polymerization degree of the PVA, there have never been found PVA fibers satisfying the relationships [$WTb \geqq 1.2(\overline{P})^{0.35}+117$] and [$DT \geqq 12(\overline{P})^{0.1}-7.5$]. The highly syndiotactic PVA fiber of the present invention therefore exhibits excellent performances in the fields of for example reinforcement of cement which require autoclaving, reinforcement for rubbers or plastics which will be subjected to wet heat treatment or used in high temperature water and industrial textiles which should be durable to rain or seawater for a long period of time. The fiber also has a melting Point at least 5° C. higher than conventional atactic PVA fibers and can hence advantageously be used in fields where high thermal resistance is required.

Other features of the invention will become apparent in the course of the following descriptions of exemplary embodiments which are given for illustration of the invention and are not intended to be limiting thereof.

In the Examples various property data and parameters were measured according to the following methods.

(1) Breaking temperature in hot water (WTb)

A bundle of 25 filaments under a load of 2 mg/denier is hung in the middle Part of a glass cylindrical container filled with water and sealed. The water is heated from the surroundings at a rate of 1° to 2° C./min and the temperature at which the filament bundle breaks by dissolution is measured.

(2) Melting Point

A differential scanning calorimeter made by Perkin-Elmer (type: DSC-2C) is used. A 10-mg sample of filaments cut to about 1 mm was taken and the melting point (endothermic Peak temperature) of the sample in a nitrogen gas stream heated at a rate of 10° C./min is determined.

(3) Single-filament strength and elastic modulus

JIS L1013 is applied. A specimen single filament which has been conditioned beforehand is laid on a base paper with its both ends patched thereon with an adhesive in such a way that the gauge length will be 10 cm, and allowed to stand for at least 12 hours at 25° C., 60% RH. Then, the base paper and specimen is mounted on Instron 1122 with a 2-kg chuck, the paper only is cut in its middle part, and the specimen is tested for breaking load, elongation at break and elastic modulus under an initial load of 1/20 g/d and at an extension rate of 50%/min. An average of n=20 is reported. The fineness is determined by weight method on a specimen filament cut to 30 cm under a load of 1/10 g/d. The samples having tested for fineness are used for determination of strength, elongation and elastic modulus, so that these properties correspond to the fineness for each filament.

EXAMPLES

Example 1

Preparation of PVA

A reaction vessel equipped with a stirrer was charged with 600 parts of vinyl pivalate monomer and 200 parts of methanol, and the inside atmosphere was replaced with nitrogen by nitrogen gas bubbling. Separately, a solution of 0.0712 part of 2,2'-azobisisobutyronitrile as an initiator in 26 parts of methanol was prepared and the system was substituted with nitrogen by nitrogen gas bubbling. The reaction vessel was heated and, when the inside temperature reached 60° C., the initiater solution in methanol was injected to start polymerization. After 190 minutes, When the conversion reached 50%, the vessel was cooled to stop polymerization. Then, with occasional addition of t-butanol unconverted vinyl pivalate monomer was removed under reduced pressure to obtain polyvinyl pivalate solution in t-butanol. The t-butanol was then removed under reduced pressure with occasional addition of tetrahydrofuran to obtain a 15 wt % polyvinyl pivalate solution in tetrahydrofuran.

Into a reaction vessel equipped with a stirrer and a reflux condenser 70 parts of the obtained solution was placed, and the contents were heated to 60° C. The system was substituted with nitrogen by streaming nitrogen gas and, while the temperature was kept at 60° C., 21 parts of a 25% potassium hydroxide solution in methanol which had separately been prepared and substituted with nitrogen was added, followed by sufficient stirring. The system geled in about 20 minutes, and, after being kept for additional 100 minutes at 60° C., was neutralized by addition of 6.8 parts of acetic acid together with 20 Parts of methanol. The gel thus obtained was washed with methanol in a Soxhlet extractor, to give a polyvinyl alcohol. The polyvinyl alcohol thus obtained was dissolved in $d_6$-DMSO and tested by NMR spectrometry, which revealed that the PVA had a saponification degree of 99.5 mol %, a syndiotacticity of 61.2%, a vinyl pivalate content of 0.5 mol % and a melting point of 241° C. To 0.5 part of the polyvinyl alcohol was added 10 parts of acetic anhydride and 2 parts of pyridine, and the system was, after being sealed, heated for 8 hours at 120° C. to effect acetylation. The polyvinyl acetate thus obtained was precipitated from n-hexane and then purified by reprecipitation from acetone/n-hexane system twice.

The viscosity average polymerization degree of the polyvinyl acetate obtained from [η] determined in acetone at 30° C. was 1920.

Preparation of PVA fiber

The PVA obtained above was dissolved in DMSO to a concentration of 17% by weight. The solution was extruded through a spinneret having 80 holes with a diameter of 0.12 mm at 90° C. into a coagulation bath the surface of which was located 20 mm below the spinneret, to be subjected to drY-jet-wet spinning. The coagulation bath had a composition of methanol/DMSO=7/3 and was at 5° C. The bundle of transparent gel filaments obtained were wet drawn to a ratio of 3, removed of the solvent with methanol and dried at 80° C. The filament bundle was drawn to 1.8 times through a 1st hot air circulating oven at 160° C., and then drawn through a 2nd and 3rd ovens at 210° C. and 240° C. respectively, thus being subjected to 3-stage dry heat drawing in a total drawing ratio of 20.8. The filaments thus obtained had a single-filament strength and modulus of 20.4 g/d and 480 g/d, respectively and a WTb of 142° C., all of which were excellent values.

Comparative Example 1

An atactic polyvinyl alcohol having a syndiotacticity of 53%, a polymerization degree of 2,000 and a saponification degree of 99.89 mol % was dissolved in DMSO to a concentration of 16% by weight. The solution obtained was spun, dried and drawn to a total drawing ratio of 20.1, in the same manners as in Example 1. The drawn fiber had a single-filament fineness, strength, initial modulus and elongation of 6.0 d, 15.5 g/d, 350 g/d and 4.7%, respectively. This fiber had a WTb of 125° C. and a melting point of 245° C.

As shown in Table 1, the present invention can provide a high-performance fiber having a high breaking temperature in hot water and being excellent in strength and elastic modulus even when the PVA used is of not so high polymerization degree.

TABLE 1

| | PVA | | | Dry heat drawing | | Single-filament properties | | Breaking | Melting |
|---|---|---|---|---|---|---|---|---|---|
| | Polymerization degree P | Syndiotacticity (%) | Content of vinyl pivalate (mol %) | Temperature at 1st-3rd ovens (°C.) | Total drawing ratio (times) | Strength (g/d) | Elastic modulus (g/d) | temperature in hot water, WTb (°C.) | point of hot-drawn fiber (°C.) |
| Example 1 | 1,920 | 61.2 | 0.5 | 160<br>210<br>240 | 20.8 | 20.4 | 480 | 142 | 257 |
| Comparative Example 1 | 2,000 | 53 | — | 160<br>210<br>240 | 20.1 | 15.5 | 350 | 125 | 245 |

Example 2

A PVA having a viscosity average polymerization degree of 7,500, a saponifiation degree of 99.0 mol %, a syndiotacticity of 61.8% and a vinyl pivalate content of 1.0 mol % was prepared in a manner similar to that in Example 1. The pVA had a melting point of 248° C.

The PVA was dissolved in glycerin with stirring at 180° C. for 6 hours under an atmosphere of nitrogen, to a cencentration of 9% by weight.

The solution thus obtained was extruded through a spinneret having 150 holes with a diameter of 0.17 mm at 190° C., by dry-jet-wet spinning, into a coagulation bath located 15 mm below the spinneret. The coagulation bath had a composition of methanol/-glycerine=7/3 and was at 0° C.

The filaments leaving the coagulation bath were transparent gel filaments having nearly true circular cross section. The filament bundle was wet drawn in methanol at 40° C. to a ratio of 4, removed of the solvent almost completely by extraction with a methanol bath and then dried with hot air at 90° C. to remove methanol.

The filament bundle was then dry heat drawn, through a 1st and a 2nd hot air circulating ovens at a temperature of 170° C. and 246° C. respectively, in a total drawing ratio of 18.5.

The obtained fiber had properties as shown in Table 2.

Example 3

A PVA having a viscosity average polymerization degree of 17,000, a saponifiation degree of 99.0 mol %, a syndiotacticity of 62.4% and a vinyl pivalate content of 1.0 mol % was prepared in a manner similar to that in Example 1. The PVA had a melting point of 252° C.

The PVA was dissolved in glycerine with stirring at 180° C. for 6 hours under an atmosphere of nitrogen, to a cencentration of 5% by weight The solution thus obtained was extruded through the same spinneret as used in Example 2 and having 150 holes with a diameter of 0.17 mm at 200° C., by dry-jet-wet spinning, into a coagulation bath located 15 mm below the spinneret. The coagulation bath had a composition of methanol/glycerine=7/3 and at 0° C.

The filaments leaving the coagulation bath were also transparent gel filaments having nearly true circular cross section. The filament bundle was, in the same manner as in Example 2. wet drawn in methanol at 40° C. to a ratio of 4, removed of the solvent almost completely by extraction with a methanol bath and then dried with hot air at 90° C. to remove methanol.

The filament bundle was then dry heat drawn, through a 1st and a 2nd hot air circulating ovens at a temperature of 170° C. and 254° C. respectively, in a total drawing ratio of 17.8.

The obtained fiber had properties as shown in Table 2.

Comparative Example 2

There was used a PVA being same as that used in Example 3 in that the viscosity average polymerization degree was 17,000 and the syndiotacticity was 62.4% and different therefrom in that the vinyl Pivalate content was 13.3 mol % and the melting point was 232° C. The PVA was spun and drawn into fiber in the same manner as in Example 3 except that the 2nd drawing temperature was 242° C. and the total drawing ratio was 17.8. The properties of the fiber obtained are shown in Table 2.

Comparative Example 3·

There was used a PVA being same as that used in Example 3 in that the viscosity average polymerization degree was 17,000 and the syndiotacticity was 62.4% and different therefrom in that the vinyl pivalate content was 0.03 mol % and the melting point was 250° C. When an attempt was made to spin and draw the PVA into fiber in the same manner as in Example 3, a total drawing ratio of only 15.9 was achieved with the 2nd drawing temperature as high as 262° C. The properties of the fiber obtained are shown in Table 2. When the 2nd drawing temperature was elevated to 266° C., the drawing tension decreased due perhaps to slippage of molecules as flowing phenomena.

TABLE 2

| | PVA | | | Dry heat drawing | | Single-filament properties | | Breaking | Melting |
|---|---|---|---|---|---|---|---|---|---|
| | Polymerization degree P | Syndiotacticity (%) | Content of vinyl pivalate (mol %) | Temperature at 1st-2nd ovens (°C.) | Total drawing ratio (times) | Strength (g/d) | Elastic modulus (g/d) | temperature in hot water, WTb (°C.) | point of hot-drawn fiber (°C.) |
| Example 2 | 7,500 | 61.8 | 1.0 | 170-246 | 18.5 | 23.7 | 580 | 152 | 260 |
| Example 3 | 17,000 | 62.4 | 1.0 | 170-254 | 17.8 | 25.9 | 640 | 160 | 264 |
| Comparative Example 2 | 17,000 | 62.4 | 13.3 | 170-242 | 17.8 | 22.4 | 530 | 139 | 253 |
| Comparative Example 3 | 17,000 | 62.4 | 0.03 | 170-262 | 15.9 | 19.0 | 485 | 148 | 261 |

Examples 2 and 3 in Table 2 show that the PVA's having a syndiotacticity and vinyl pivalate content in the range defined by the present invention and further having an elevated polymerization degree can provide fibers having still more excellent hot water resistance and mechanical properties.

Thus, in Example 2 the use of a specific PVA and an appropriate control of the oven temperatures made it possible to achieve a total drawing ratio as high as that with fibers from atactic PVA, thereby yielding a fiber having excellent mechanical properties. Besides, this fiber had a very high breaking temperature in hot water, about 18° C. higher than that of fibers from conventional atactic PVA, which is considered to be due to its more complete crystallization. This fiber also showed a very high melting point, proving its excellent thermal resistance.

In Example 3, where the PVA used had still higher polymerization degree, the obtained fiber showed excellent strength and breaking temperatures that conventional PVA fibers had never achieved, and can hence be usable in the fields requiring high resistance to hot water and dry heat, thus being a very valuable fiber.

Comparative Examples 2 and 3 show that if the vinyl pivalate content of PVA is not within the Preferred range described hereinbefore, the desired fiber cannot be obtained. Thus, in Comparative Example 2, a PVA with too high a vinyl pivalate content could not, although the total drawing ratio was able to reach about the same level as that in Example 3, yield a fiber having improved properties. In Comparative Example 3, where the vinyl pivalate content was too low, the total drawing ratio could not be increased, resulting in a significant drop in the fiber properties as compared with that of Example 3.

Example 4

A pVA having a viscosity average polymerization degree of 4,500, a saPonifiation degree of 94.7 mol %, a syndiotacticitY of 58.6%, a vinyl pivalate content of 5.3 mol % and a melting point of 233° C. was dissolved in water to a cencentration of 9% by weight. The solution thus obtained was wet spun through a spinneret having 500 holes with a diameter of 0.15 mm at 110° C. The coagulation bath used was an aqueous solution containing 50 g/l of sodium hydroxide and 200 g/l of sodium sulfate and at 20.C. The bundle of filaments coagulated was wet drawn to a drawing ratio of 3, neutralized with a 300 g/l aqueous NaOH solution, wet drawn again in a 350 g/l aqueous sodium sulfate solution to a ratio of 3, washed with water and then dried by hot air at 100° C. The dried filament bundle was then 3-stage drY heat drawn, through hot air circulating ovens with a temperature gradient of 180°-200°-238° C. in a total drawing ratio of 22.8.

The fiber thus obtained had a single-filament strength and elastic modulus of 22.6 g/d and 505 g/d and a WTb of 147° C., which were all excellent.

Obviously, numerous modifications and variations of the

Present invention are possible in light of the above teachings. It is therefore to be understood that within the scope of the appended claims, the invention may be practiced otherwise than as specifically described herein.

What is claimed is:

1. A polyvinyl alcohol fiber, comprising a polyvinyl alcohol having a viscosity average polymerization degree $\bar{P}$ of at least 1,500 measured at 30° C. in acetone as $$\bar{P}=(\eta\times 1000/7.94)^{1/0.62}$$

and a syndiotacticity of at least 58% and containing vinyl pivalate monomer units, said fiber having a breaking temperature in hot water of at least 132° C. and a single-filament strength of at least 17 g/d.

2. The polyvinyl alcohol fiber according to claim 1, wherein said polyvinyl alcohol has a syndiotacticity of at least 60%.

3. The polyvinyl alcohol fiber according to claim 1, wherein said polyvinyl alcohol contains vinyl pivalate monomer units in an amount of 0.05 to 10 mol %.

4. The polyvinyl alcohol fiber according to claim 1, wherein said breaking temperature in hot water and said single-filament strength satisfy the following relationships $$WTb \geqq 1.2(\bar{P})^{0.35}+117 \quad [1]$$

$$DT \geqq 12(\bar{P})^{0.1}-7.5 \quad [2]$$

where:

WTb = breaking temperature under 2 mg/d load in hot water $\bar{P}$ = viscosity average polymerization degree of polyvinyl alcohol.

* * * * *